US010854167B2

(12) United States Patent
Yamaguchi et al.

(10) Patent No.: US 10,854,167 B2
(45) Date of Patent: Dec. 1, 2020

(54) DISPLAY DEVICE AND METHOD FOR CONTROLLING THE SAME

(71) Applicant: Sharp Kabushiki Kaisha, Sakai (JP)

(72) Inventors: Noriaki Yamaguchi, Sakai (JP); Hidekazu Miyata, Sakai (JP); Masafumi Yashiki, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/449,508

(22) Filed: Jun. 24, 2019

(65) Prior Publication Data

US 2020/0051523 A1 Feb. 13, 2020

Related U.S. Application Data

(60) Provisional application No. 62/715,814, filed on Aug. 8, 2018.

(51) Int. Cl.
*G09G 5/36* (2006.01)
*G09G 5/00* (2006.01)

(52) U.S. Cl.
CPC ..... *G09G 5/005* (2013.01); *G09G 2360/128* (2013.01)

(58) Field of Classification Search
CPC ..... G09G 3/006; G09G 2320/0295; G09G 2360/18; G09G 2320/0285; G09G 2320/029; G09G 2320/103; G09G 2360/128; G06T 1/60
See application file for complete search history.

(56) References Cited

U.S. PATENT DOCUMENTS

2002/0184578 A1* 12/2002 Yoshizawa ..... G11C 29/20 714/718
2008/0001935 A1* 1/2008 Nurmi ..... G09G 3/006 345/204
2009/0040151 A1 2/2009 Lee
2012/0075320 A1* 3/2012 Handschy ..... G09G 3/3629 345/559
2017/0262731 A1* 9/2017 Uetani ..... G06K 9/00993

FOREIGN PATENT DOCUMENTS

JP 2009-042711 A 2/2009

* cited by examiner

*Primary Examiner* — Hau H Nguyen
(74) *Attorney, Agent, or Firm* — Keating & Bennett, LLP

(57) ABSTRACT

A display device includes a display panel, a frame memory, a display control circuit that performs a predetermined process on a first video signal using the frame memory and outputs an obtained second video signal, and a panel drive circuit that drives the display panel based on the second video signal. The display control circuit checks whether the frame memory is normal or abnormal, by storing partial video data included in the first video signal, writing to the frame memory, video data obtained by replacing the partial video data with first test data, and comparing with the first test data, second test data included in the video data read from the frame memory.

12 Claims, 10 Drawing Sheets

*Fig. 5*

| NUMBER | DATA |
|---|---|
| 1 | 0000_0001 |
| 2 | 0000_0010 |
| 3 | 0000_0100 |
| 4 | 0000_1000 |
| 5 | 0001_0000 |
| 6 | 0010_0000 |
| 7 | 0100_0000 |
| 8 | 1000_0000 |
| 9 | 0000_0101 |
| 10 | 0000_1010 |
| 11 | 0001_0100 |
| 12 | 0010_1000 |
| 13 | 0101_0000 |
| 14 | 1010_0000 |
| 15 | 0100_0001 |
| 16 | 1000_0010 |

| NUMBER | DATA |
|---|---|
| 17 | 0000_1001 |
| 18 | 0001_0010 |
| 19 | 0010_0100 |
| 20 | 0100_1000 |
| 21 | 1001_0000 |
| 22 | 0010_0001 |
| 23 | 0100_0010 |
| 24 | 1000_0100 |
| 25 | 0001_0001 |
| 26 | 0010_0010 |
| 27 | 0100_0100 |
| 28 | 1000_1000 |
| 29 | 0001_0101 |
| 30 | 0010_1010 |
| 31 | 0101_0100 |
| 32 | 1010_1000 |

DISPLAY DEVICE AND METHOD FOR CONTROLLING THE SAME

CROSS-REFERENCE TO RELATED APPLICATION

This application claims the benefit of U.S. Provisional Patent Application No. 62/715,814 filed on Aug. 8, 2018, and entitled "Display Device And Method For Controlling The Same", which is incorporated herein by reference in its entirety.

BACKGROUND OF THE INVENTION

Field of the Invention

The present invention relates to a display device, and especially relates to a display device including a frame memory and a method for controlling the same.

Description of Related Art

Display devices, such as a liquid crystal display device, an organic EL (Electro Luminescence) display device, and an LED (Light Emitting Diode) display device, are provided with a frame memory if necessary. For example, a field sequential system display device is provided with the frame memory in order to convert a video signal of one frame into a video signal of a plurality of fields. Furthermore, a display device performing an overshoot drive is provided with the frame memory in order to store a video data of a previous frame. In many cases, a dynamic random access memory (hereinafter referred to as DRAM) is used as the frame memory.

Related to the invention of the present application, Japanese Laid-Open Patent Publication No. 2009-42711 discloses an organic EL display device that resets a frame memory based on a signal indicating whether a video corresponds to a moving picture or a still picture and a signal indicating a comparison result between an intensity of outer light and a reference value.

The DRAM may fall in a state (hereinafter referred to as an abnormal state) in which written data cannot be read correctly, when affected by noise. Since the DRAM continues to malfunction in the abnormal state at this time, a malfunction of the DRAM cannot be detected unless some process is performed. Thus, the display device including the DRAM as the frame memory has a problem that an abnormal display occurs when the DRAM falls in the abnormal state.

SUMMARY OF THE INVENTION

Therefore, providing a display device capable of suppressing an abnormal display due to a malfunction of a frame memory is taken as a problem.

(1) A display device according to some embodiments of the present invention includes: a display panel; a frame memory; a display control circuit configured to perform a predetermined process on a first video signal using the frame memory and output an obtained second video signal; and a panel drive circuit configured to drive the display panel based on the second video signal, and the display control circuit is configured to check whether the frame memory is normal or abnormal, by storing partial video data included in the first video signal, writing to the frame memory, video data obtained by replacing the partial video data with first test data, and comparing with the first test data, second test data included in the video data read from the frame memory.

(2) The display device according to some embodiments of the present invention has a configuration of above (1), and the display control circuit is configured to replace the second test data with the partial video data when the frame memory is normal, and reset the frame memory when the frame memory is abnormal.

(3) The display device according to some embodiments of the present invention has a configuration of above (2), and the frame memory is a dynamic random access memory having a reset function.

(4) The display device according to some embodiments of the present invention has a configuration of above (3), and the partial video data is pixel data of a plurality of pixels aligned along an edge of a display screen.

(5) The display device according to some embodiments of the present invention has a configuration of above (4), and the partial video data is the pixel data of the plurality of pixels aligned in a horizontal direction from an upper left corner of the display screen.

(6) The display device according to some embodiments of the present invention has a configuration of above (5), and the partial video data is included in a head portion of the first video signal of one frame.

(7) The display device according to some embodiments of the present invention has a configuration of above (4), the display device is a field sequential system display device, and the partial video data is the pixel data of a first field of the plurality of pixels aligned in a horizontal direction from an upper left corner of the display screen.

(8) The display device according to some embodiments of the present invention has a configuration of above (7), and the partial video data is included in a head portion of the first video signal of one frame.

(9) The display device according to some embodiments of the present invention has a configuration of above (4), the display device is a field sequential system display device, and the partial video data is the pixel data of each field of the plurality of pixels aligned in a horizontal direction from a lower right corner of the display screen.

(10) The display device according to some embodiments of the present invention has a configuration of above (9), and the partial video data is included in a tail portion of the first video signal of one frame.

(11) The display device according to some embodiments of the present invention has a configuration of above (3), the first test data includes a plurality of pieces of data that are different from each other, and with respect to any bit of the data, the first test data includes data having zero as a value of the bit and data having one as the value of the bit.

(12) A method for controlling a display device according to some embodiments of the present invention is a method for controlling a display device including a display panel and a frame memory, the method includes: performing a predetermined process on a first video signal using the frame memory and outputting an obtained second video signal; driving the display panel based on the second video signal; and checking whether the frame memory is normal or abnormal, and checking includes: storing partial video data included in the first video signal; writing to the frame memory, video data obtained by replacing the partial video data with first test data; and comparing with the first test data, second test data included in the video data read from the frame memory.

(13) The method for controlling the display device according to some embodiments of the present invention has a configuration of above (12), and checking further includes: replacing the second test data with the partial video data when the frame memory is normal; and resetting the frame memory when the frame memory is abnormal.

(14) The method for controlling the display device according to some embodiments of the present invention has a configuration of above (13), and the frame memory is a dynamic random access memory having a reset function.

According to the above display device and the method for controlling the same, whether the frame memory is normal or abnormal can be checked by writing to the frame memory, the video data obtained by replacing the partial video data with the first test data, and comparing with the first test data, the second test data included in the video data read from the frame memory. An abnormal display due to a malfunction of the frame memory can be suppressed by resetting the frame memory when the frame memory is abnormal.

These and other objects, features, modes and effects of the present invention will be more apparent from the following detailed description with reference to the attached drawings.

BRIEF DESCRIPTION OF THE DRAWINGS

FIG. 5 is a diagram showing an example of test data in the display device shown in FIG. 1.

DETAILED DESCRIPTION OF THE INVENTION

First Embodiment

Figure 1:
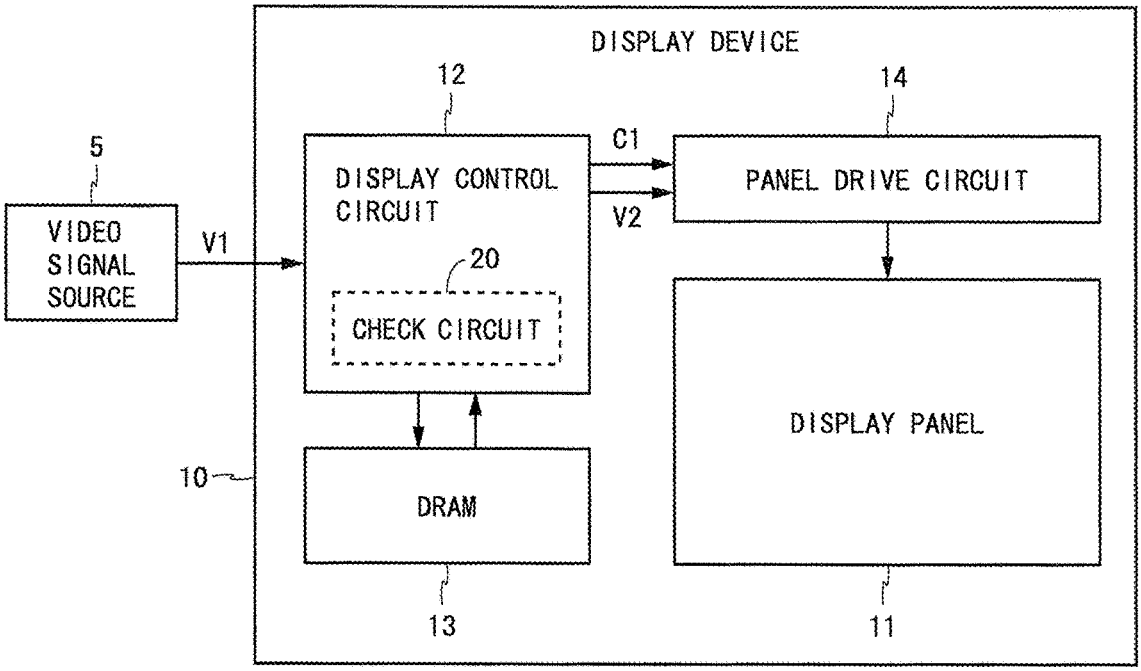
FIG. 1 is a block diagram showing a configuration of a display device according to a first embodiment.

FIG. 1 is a block diagram showing a configuration of a display device according to a first embodiment. A display device 10 shown in FIG. 1 includes a display panel 11, a display control circuit 12, a DRAM 13, and a panel drive circuit 14. In the following, m, n, p, and q are integers not smaller than 2.

The display panel 11 includes (m×n) pixels (not shown) arranged two-dimensionally. In a horizontal direction of a display screen, m pixels are aligned, and in a vertical direction of the display screen, n pixels are aligned. A kind of the display panel 11 may be arbitrary. For example, the display panel 11 may be a liquid crystal panel, an organic EL panel, or an LED panel. When the display panel 11 is the liquid crystal panel, the display device 10 is a liquid crystal display device. In this case, the display device 10 may further include a backlight (not shown). When the display panel 11 is the organic EL panel, the display device 10 is an organic EL display device. When the display panel 11 is the LED panel, the display device 10 is an LED display device.

A video signal source 5 is provided at an outside of the display device 10. The video signal source 5 outputs a video signal V1 to the display device 10. The display device 10 displays an image on the display panel 11 based on the video signal V1 output from the video signal source 5.

Based on the video signal V1, the display control circuit 12 outputs a control signal C1 and a video signal V2 to the panel drive circuit 14. The DRAM 13 is a work memory of the display control circuit 12 and functions as a frame memory. The DRAM 13 stores video data included in the video signal V1, video data included in the video signal V2, intermediate data generated when transforming the video data, and the like. The panel drive circuit 14 drives the display panel 11 based on the control signal C1 and the video signal V2 output from the display control circuit 12.

When the display device 10 is a field sequential system display device, the video signal V1 is a video signal in unit of frame and the video signal V2 is a video signal in unit of field. The video signal in unit of field means a video signal of a blue field, a video signal of a green field, a video signal of a red field, and the like, for example. In this case, the display control circuit 12 writes the video data included in the video signal V1 to the DRAM 13 in unit of frame, reads the video data from the DRAM 13 in unit of field, and outputs the video signal V2 including the read video data to the panel drive circuit 14.

When the display device 10 is a display device performing an overshoot drive, both of the video signals V1, V2 are video signals in unit of frame. In this case, the display control circuit 12 writes the video data included in the video signal V1 to the DRAM 13 in unit of frame, and reads the video data from the DRAM 13 in unit of frame after one frame period. The display control circuit 12 performs an overshoot process (process for emphasizing a temporal change of data), with taking the video data included in the video signal V1 as video data of a current frame and taking the video data read from the DRAM 13 as video data of a previous frame, and outputs the video signal V2 including obtained video data to the panel drive circuit 14.

In this manner, the display control circuit 12 performs a predetermined process on the video signal V1 using the DRAM 13 and outputs the obtained video signal V2. In addition, the display control circuit 12 performs a process (hereinafter referred to as a check process) for checking whether the DRAM 13 is normal or abnormal and resetting the DRAM 13 when the DRAM 13 is abnormal. In order to perform the check process, a check circuit 20 is provided to the display control circuit 12, and a DRAM having a reset function is used as the DRAM 13. As the DRAM 13 having the reset function, a DDR3 SDRAM (Double Data Rate 3 Synchronous Dynamic Random Access Memory) is used, for example.

Figure 2:
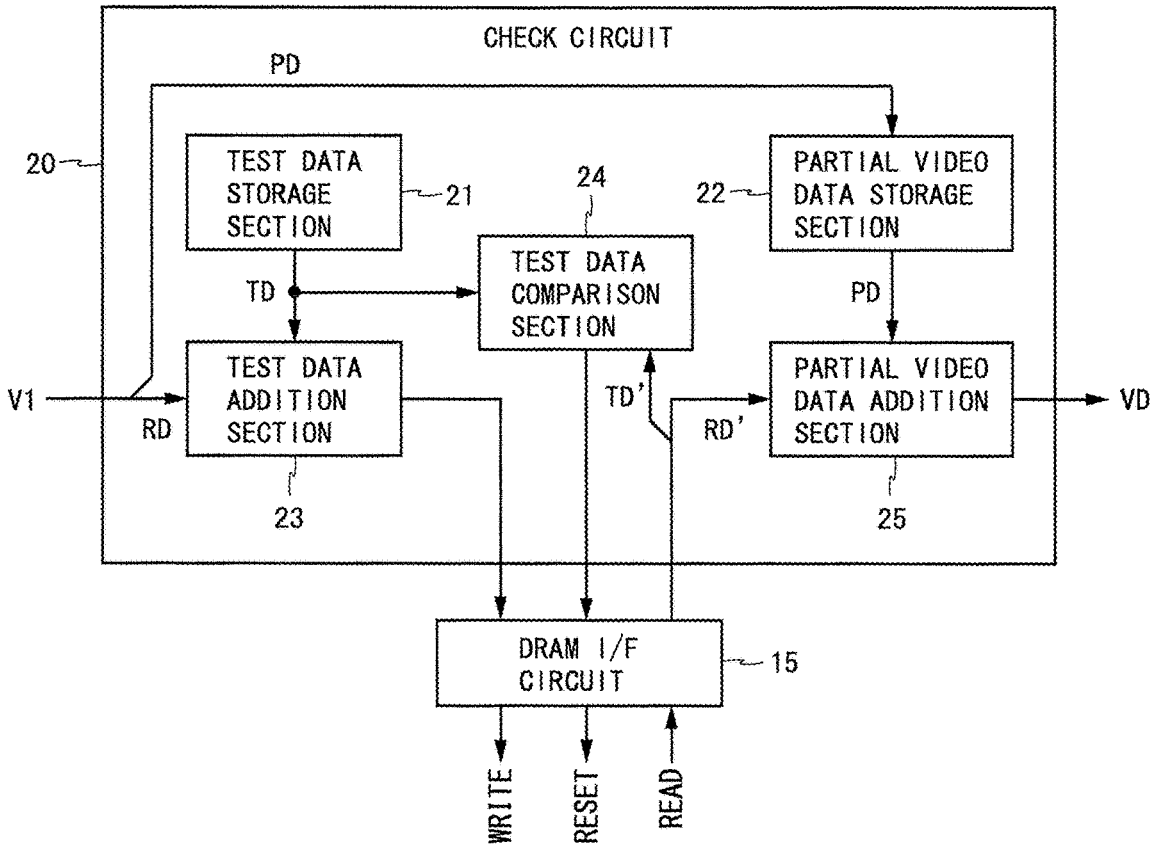
FIG. 2 is a block diagram showing details of a check circuit of the display device shown in FIG. 1.
Figure 3:
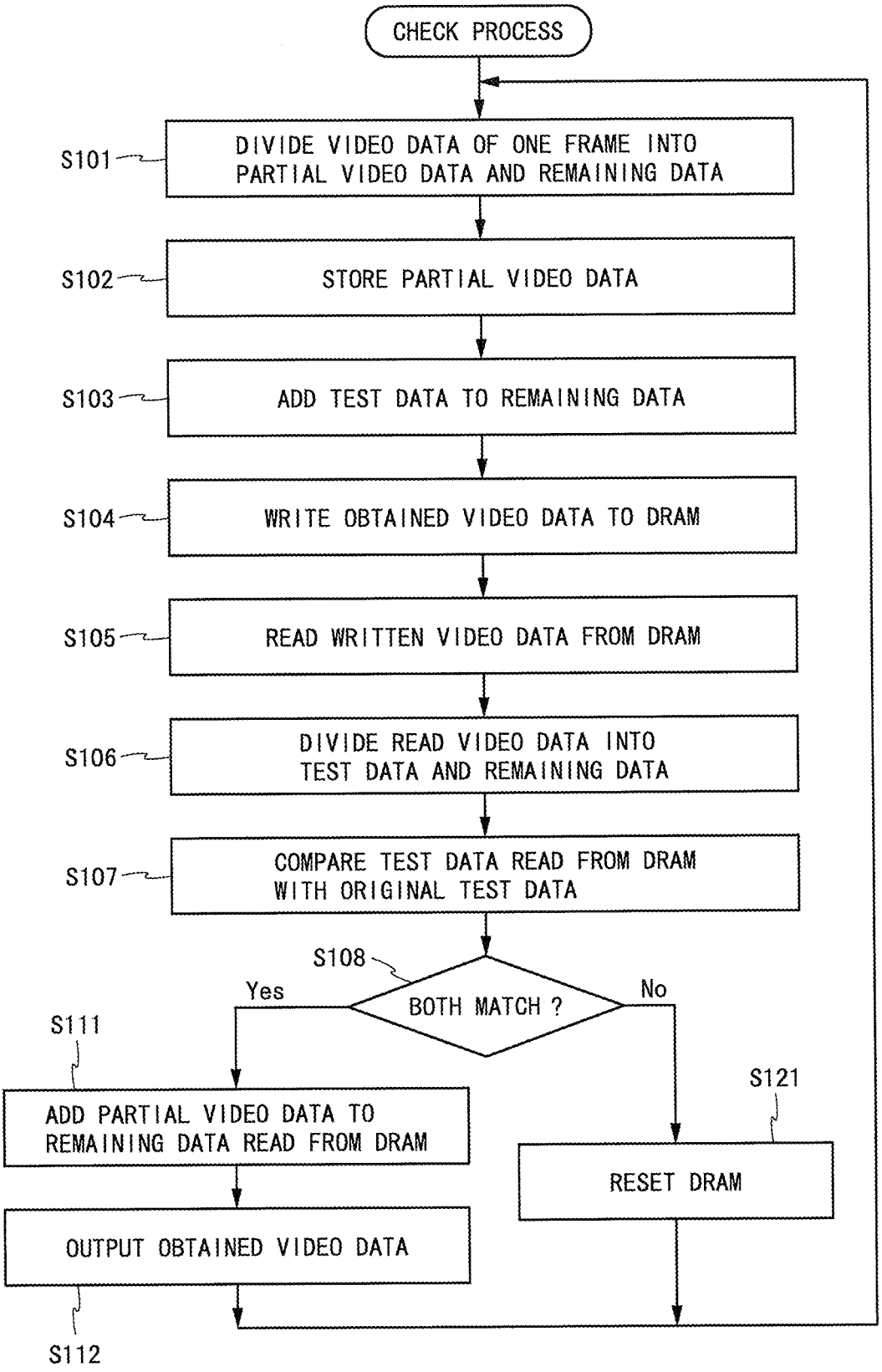
FIG. 3 is a flowchart of a check process in the display device shown in FIG. 1.
Figure 4:
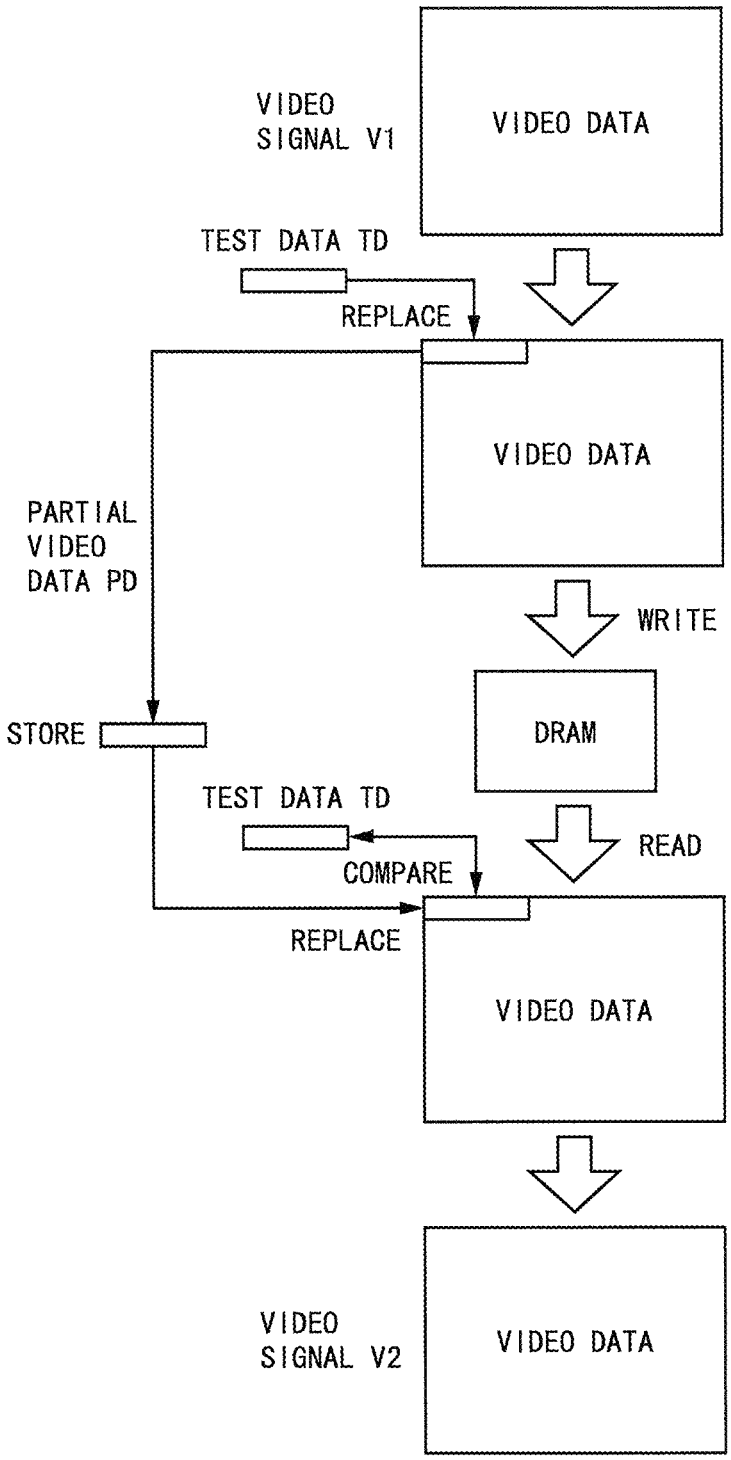
FIG. 4 is a diagram for explaining the check process in the display device shown in FIG. 1.

FIG. 2 is a block diagram showing details of the check circuit 20. As shown in FIG. 2, the check circuit 20 includes a test data storage section 21, a partial video data storage section 22, a test data addition section 23, a test data comparison section 24, and a partial video data addition section 25. FIG. 3 is a flowchart of the check process. FIG. 4 is a diagram for explaining the check process. In the following, the display device 10 is assumed to be a display device performing the overshoot drive.

When the display panel 11 includes (m×n) pixels, (m×n) pieces of pixel data are included in the video signal V1 of one frame. Hereinafter, whole pixel data included in the video signal V1 of one frame is referred to as "video data of one frame" and a data width of the pixel data is assumed to be q bits. In the present embodiment, p pixels aligned in the horizontal direction from an upper left corner of the display screen (p pixels aligned in a top line of the display screen in a left-justified manner) are taken as specific pixels, and the pixel data of the specific pixels in the video data of one frame is referred to as partial video data PD (see FIG. 4). The partial video data PD includes p pieces of pixel data, each having q bits. The partial video data PD is included in a head portion of the video signal V1 of one frame.

The test data storage section 21 stores test data TD having a same format as the partial video data PD. The test data TD includes p pieces of q-bit data as with the partial video data PD. The test data TD is fixed data determined in advance. Details of the test data TD will be described later.

As shown in FIG. 3, the check circuit 20 divides the video data of one frame included in the video signal V1 of one frame into the partial video data PD and remaining data RD (step S101). The former is output to the partial video data storage section 22, and the latter is output to the test data addition section 23. The partial video data storage section 22 stores the partial video data PD obtained in step S101 (step S102).

The test data addition section 23 adds the test data TD stored in the test data storage section 21, to the remaining data RD obtained in step S101 (step S103). The test data TD is added at a position where the partial video data PD has been existed. With this, the video data of one frame is obtained. The obtained video data of one frame is output to a DRAM interface circuit 15 in the display control circuit 12. The DRAM interface circuit 15 writes to the DRAM 13, the video data of one frame obtained in step S103 (step S104). As a result, video data of one frame obtained by replacing the partial video data PD with the test data TD in the original video data of one frame is written to the DRAM 13.

After that, the DRAM interface circuit 15 reads from the DRAM 13, the video data of one frame written in step S104 (step S105). The check circuit 20 divides the video data of one frame read from the DRAM 13 into test data TD' and remaining data RD' (step S106). The former is output to the test data comparison section 24, and the latter is output to the partial video data addition section 25.

The test data comparison section 24 compares the test data TD' read from the DRAM 13 with the original test data TD (step S107). More specifically, in step S107, the test data comparison section 24 compares the test data TD' included in the video data of one frame read from the DRAM 13 with the test data TD stored in the test data storage section 21. When both match, the test data comparison section 24 determines that the DRAM 13 is normal and goes to step S111. When both do not match, the test data comparison section 24 determines that the DRAM 13 is abnormal and goes to step S121 (step S108).

When the DRAM 13 is normal (when Yes in step S108), the partial video data addition section 25 adds the partial video data PD to the remaining data RD' read from the DRAM 13 (step S111). More specifically, in step S111, the partial video data addition section 25 adds the partial video data PD stored in the partial video data storage section 22, to the remaining data RD' included in the video data of one frame read from the DRAM 13. The partial video data PD is added at an original position. With this, the video data VD of one frame is obtained. The check circuit 20 outputs the video data VD of one frame obtained in step S111 (step S112). The video signal V2 output from the display control circuit 12 to the panel drive circuit 14 includes a result obtained by performing the overshoot process, with taking the video data included in the video signal V1 as a video data of a current frame and taking the video data VD as a video data of a previous frame.

When the DRAM 13 is abnormal (when No in step S108), the test data comparison section 24 outputs a reset instruction to the DRAM interface circuit 15. The DRAM interface circuit 15 resets the DRAM 13 in accordance with the reset instruction (step S121). The DRAM 13 performs an initialization process when receiving the reset instruction. Until the DRAM 13 completes the initialization process, the display control circuit 12 stops outputting of the control signal C1, and the panel drive circuit 14 stops driving of the display panel 11.

After performing step S112 or step S121, the check circuit 20 goes to step S101. The check circuit 20 performs the above process on the video signal V1 of next one frame.

In this manner, the display control circuit 12 checks whether the DRAM 13 is normal or abnormal, by storing the partial video data PD (pixel data of the p specific pixels aligned in the horizontal direction from the upper left corner of the display screen) included in the video signal V1, writing to the DRAM 13, the video data obtained by replacing the partial video data PD with the test data TD, and comparing with the test data TD, the test data TD' included in the video data read from the DRAM 13. The display control circuit 12 replaces the test data TD' with the partial video data PD when the DRAM 13 is normal, and resets the DRAM 13 when the DRAM 13 is abnormal.

FIG. 5 is a diagram showing an example of the test data TD. In the example shown in FIG. 5, p=32 and q=8 (the number of data is 32 and a data width is 8 bits). A data width of the data included in the test data TD is same as that of the pixel data included in the video signal V1. The test data TD is determined so that following conditions 1 and 2 are satisfied. It is preferable that the test data TD satisfy a following condition 3.

condition 1: All pieces of data included in the test data TD are different from each other.

condition 2: With respect to any bit, the test data TD includes data having '0' as a value of the bit and data having '1' as the value of the bit.

condition 3: The test data TD does not include all 0 data and all 1 data.

Figure 6:
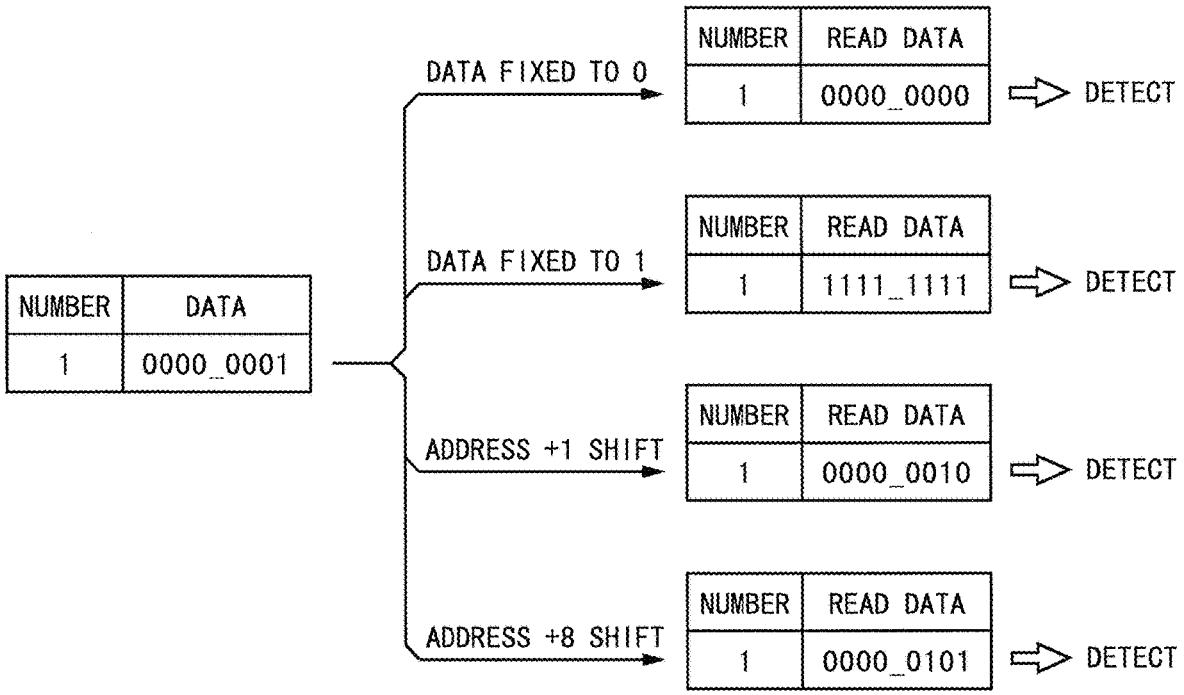
FIG. 6 is a diagram showing an example of an abnormality detection using the test data shown in FIG. 5.

FIG. 6 is a diagram showing an example of an abnormality detection using the test data TD. When the DRAM 13 malfunctions, read data may become all 0 or all 1, or a bit position may shift because an address becomes abnormal. In the test data TD shown in FIG. 5, first data is "00000001". When the read data is changed to all 0 by a malfunction of the DRAM 13, the first data included in the test data TD' becomes "00000000". When the read data is changed to all 1 by a malfunction of the DRAM 13, the first data included in the test data TD' becomes "11111111". When the address is shifted by +1 by a malfunction of the DRAM 13, the first data in the test data TD' becomes "00000010". When the address is shifted by +8 (unit of burst transfer) by a malfunction of the DRAM 13, the first data in the test data TD' becomes "00000101". In any case, an abnormality of the DRAM 13 can be detected by comparing the test data TD with the test data TD'.

When the test data TD satisfies the above conditions 1 and 2, an abnormality by which the read data is changed to all 0 or all 1 and an abnormality by which a bit position is shifted can be detected certainly. Therefore, the abnormality of the DRAM 13 can be detected with a high accuracy.

Figure 7:
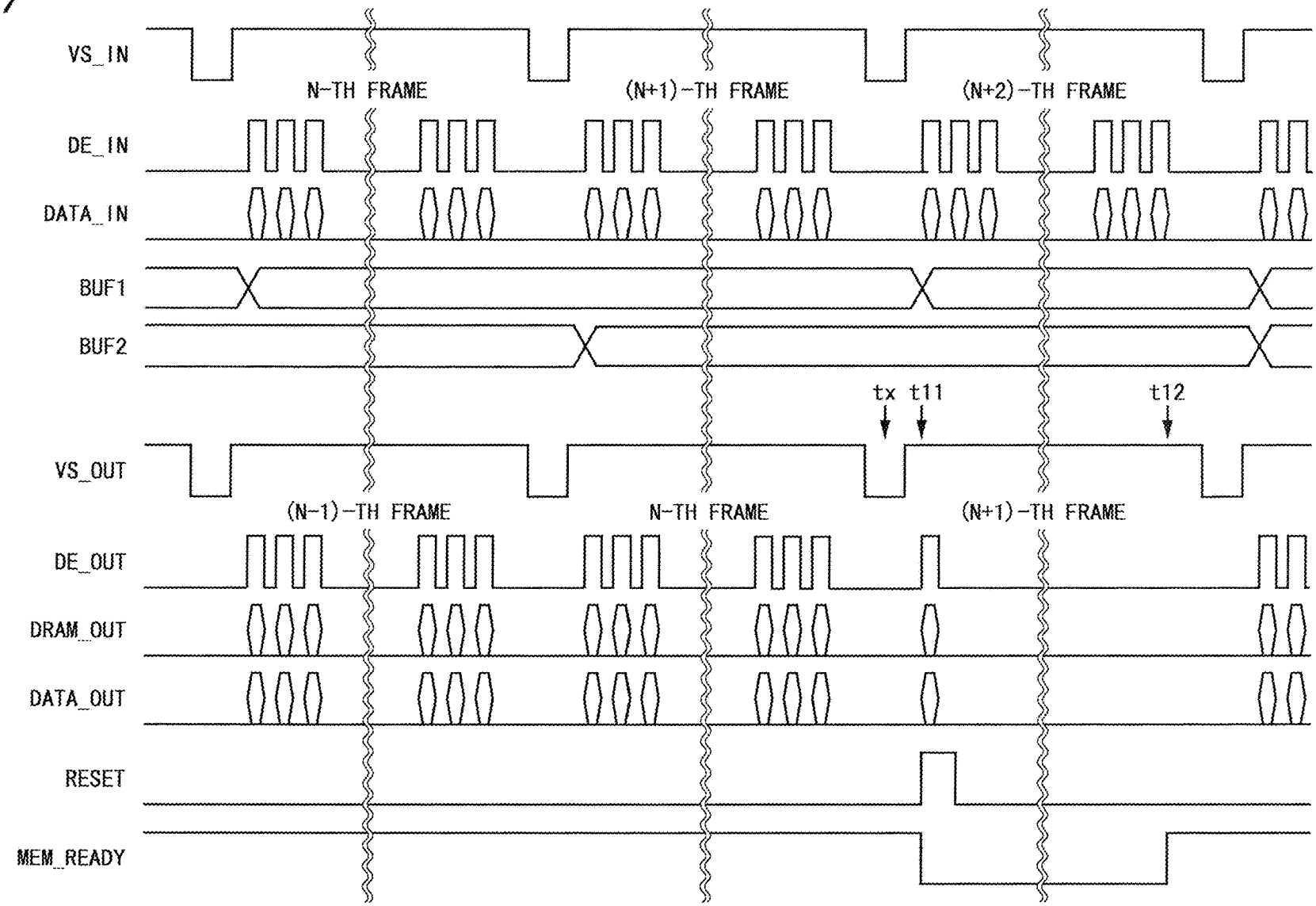
FIG. 7 is a timing chart of a display control circuit of the display device shown in FIG. 1.

FIG. 7 is a timing chart of the display control circuit 12. In FIG. 7, VS_IN is a vertical synchronization signal included in the video signal V1, DE_IN is a signal indicating a valid period of video data included in the video signal V1, and DATA_IN is the video data included in the video signal V1. VS_OUT is a vertical synchronization signal used when the video data is read from the DRAM 13 and the video data VD is output to a later stage of the display control circuit 12, DE_OUT is a signal indicating a valid period of video data read from the DRAM 13, DRAM_OUT is the video data read from the DRAM 13, and DATA_OUT is the video data VD. RESET is a reset signal of the DRAM 13, and MEM_READY is an output signal of the DRAM 13, indicating whether the DRAM 13 can be used.

When the signal DE_IN is at a high level, the video data DATA_IN is valid. When the signal DE_IN is at the high level, the video data DATA_IN is input to the display control circuit 12 and is written to the DRAM 13. However, pixel data (partial video data PD) of the p specific pixels that are input immediately after the signal VS_IN falls are replaced with p pieces of data included in the test data TD. The partial video data storage section 22 has two buffers BUF1, BUF2, each capable of storing the partial video data PD. The partial video data PD obtained from the video signal V1 of one frame is alternately written to the buffers BUF1, BUF2, and is held until it is overwritten by the partial video data PD obtained from the video signal V1 after two frame periods.

When the signal DE_OUT is at the high level, the video data DRAM_OUT is valid. When the signal DE_IN is at the high level, the video data DRAM_OUT is input to the display control circuit 12. The check circuit 20 checks whether p pieces of data (test data TD') input immediately after the signal VS_OUT falls and the test data TD match. When both match, the video data VD obtained by replacing the test data TD' with the partial video data PD stored in one of the buffers BUF1, BUF2 is output to a later stage as the signal DATA_OUT.

When both do not match, the signal RESET having a valid length for the DRAM 13 is output. A length with which the signal RESET becomes valid is different depending on the DRAM 13. When the DRAM 13 is reset, the DRAM 13 starts the initialization process. When the DRAM 13 performs the initialization process, the signal MEM_READY becomes a low level. The display control circuit 12 resumes reading from the DRAM 13 after the signal MEM_READY becomes the high level. FIG. 7 describes that when the DRAM 13 becomes the abnormal state at time tx, a malfunction of the DRAM 13 is detected at time t11, and the DRAM 13 performs the initialization process in a period from the time t11 to time t12.

As described above, the display device 10 according to the present embodiment includes the display panel 11, a frame memory (DRAM 13), the display control circuit 12 configured to perform a predetermined process on a first video signal (video signal V1) using the frame memory and output an obtained second video signal (video signal V2), and the panel drive circuit 14 configured to drive the display panel based on the second video signal. The display control circuit 12 checks whether the frame memory is normal or abnormal, by storing the partial video data PD included in the first video signal, writing to the frame memory, video data obtained by replacing the partial video data PD with first test data (test data TD), and comparing with the first test data, second test data (test data TD') included in the video data read from the frame memory.

The display control circuit 12 is configured to replace the second test data with the partial video data PD when the frame memory is normal, and reset the frame memory when the frame memory is abnormal. The frame memory is a dynamic random access memory (DRAM 13) having a reset function.

According to such a display device 10, whether the frame memory is normal or abnormal can be checked by writing to the frame memory, the video data obtained by replacing the partial video data PD with the first test data, and comparing with the first test data, the second test data included in the video data read from the frame memory. By resetting the frame memory when the frame memory is abnormal, an abnormal display due to a malfunction of the frame memory can be suppressed.

Furthermore, the partial video data PD is pixel data of a plurality of pixels (p pixels) aligned in the horizontal direction from the upper left corner of the display screen. By using such partial video data PD, it is possible to reduce an influence on a display image caused by replacing the partial video data PD with the first test data. Furthermore, the partial video data PD is included in a head portion of the first video signal of one frame. Therefore, process for replacing the partial video data PD with the first test data and process for comparing the second test data with the first test data can be performed easily.

Furthermore, the first test data includes a plurality of pieces of data (p pieces of data) that are different from each other, and with respect to any bit of the data, the first test data includes data having '0' as a value of the bit and data having '1' as the value of the bit (conditions 1 and 2). By using such first test data, the abnormality of the frame memory can be detected with a high accuracy, and the abnormal display due to the malfunction of the frame memory can be suppressed.

In the above description, the partial video data PD is pixel data of a plurality of pixels aligned in the horizontal direction from the upper left corner of the display screen. In general, the partial video data PD may be pixel data of a plurality of pixels aligned along an edge of the display screen. For example, the partial video data PD may be pixel data of a plurality of pixels aligned in the horizontal direction from a lower right corner of the display screen. Even when such partial video data PD is used, it is possible to reduce the influence on the display image by replacing the partial video data PD with the first test data.

Second Embodiment

Figure 8:
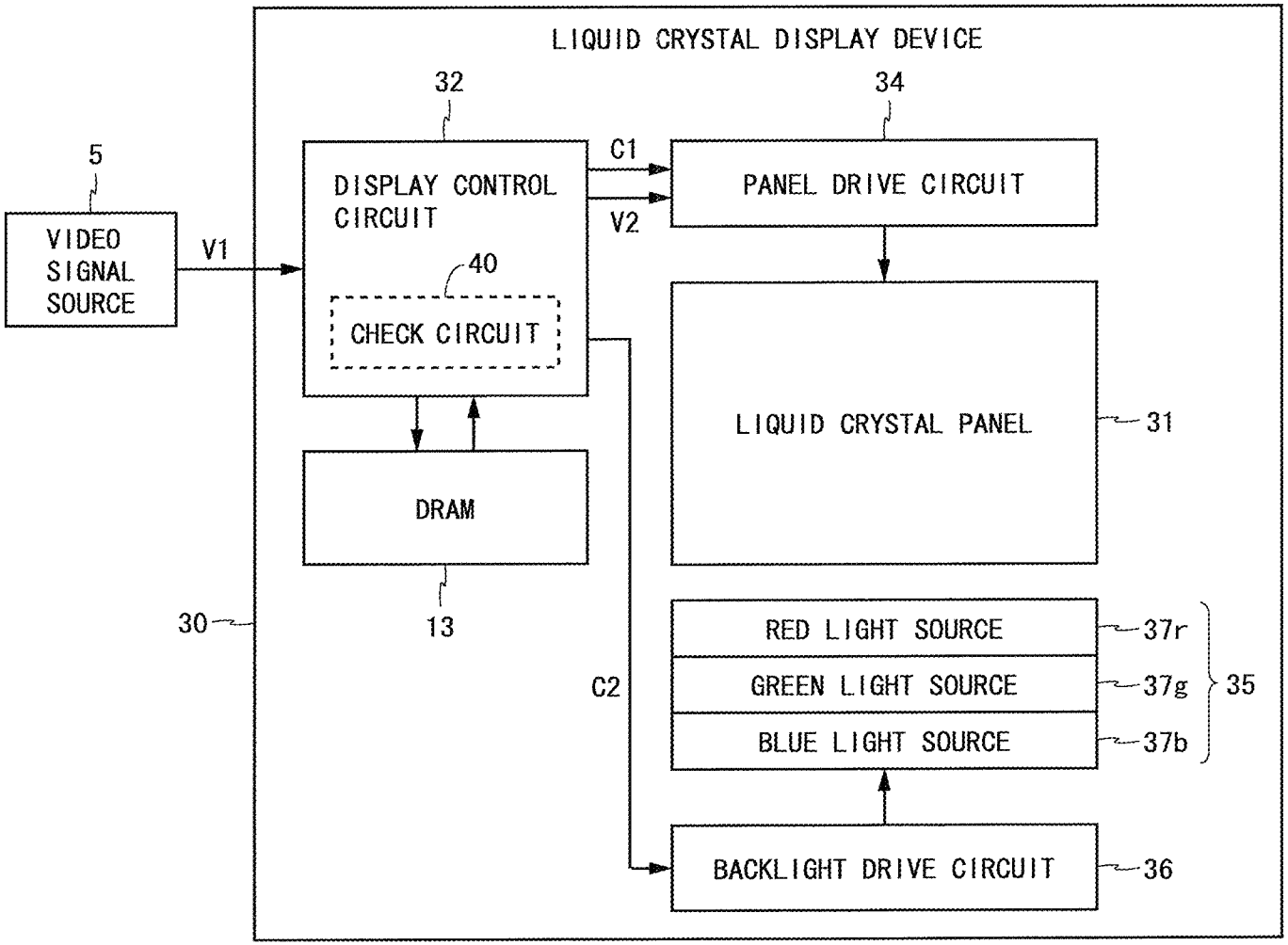
FIG. 8 is a block diagram showing a configuration of a liquid crystal display device according to a second embodiment.

FIG. 8 is a block diagram showing a configuration of a liquid crystal display device according to a second embodiment. A liquid crystal display device 30 shown in FIG. 8 includes a liquid crystal panel 31, a display control circuit 32, the DRAM 13, a panel drive circuit 34, a backlight 35, and a backlight drive circuit 36. The backlight 35 includes a red light source 37*r*, a green light source 37*g*, and a blue light source 37*b*. In the following, differences from the first embodiment are described.

The liquid crystal display device 30 is a field sequential system display device. The liquid crystal display device 30 is also a see-through type display device that allows light from the back to penetrate when a screen is not displayed.

In the liquid crystal display device 30, one frame period is divided into a blue field period, a green field period, and a red field period. The liquid crystal panel 31 does not have a color filter. The liquid crystal panel 31 includes pixels (not shown), and each pixel functions as a color pixel.

In the blue field period, the panel drive circuit 34 drives the liquid crystal panel 31 based on the video signal of a blue field, and the blue light source 37*b* emits light. With this, the blue field is displayed. Similarly, a green field is displayed in the green field period, and a red field is displayed in the red field period. The liquid crystal display device 30 performs color display using the liquid crystal panel 31 that does not have the color filter, by successively displaying the blue field, the green field, and the red field.

The display control circuit 32 converts a video signal of one frame into a video signal of three fields using the DRAM 13. As with the display control circuit 12 according to the first embodiment, the display control circuit 32 performs a check process using a check circuit 40.

Figure 9:
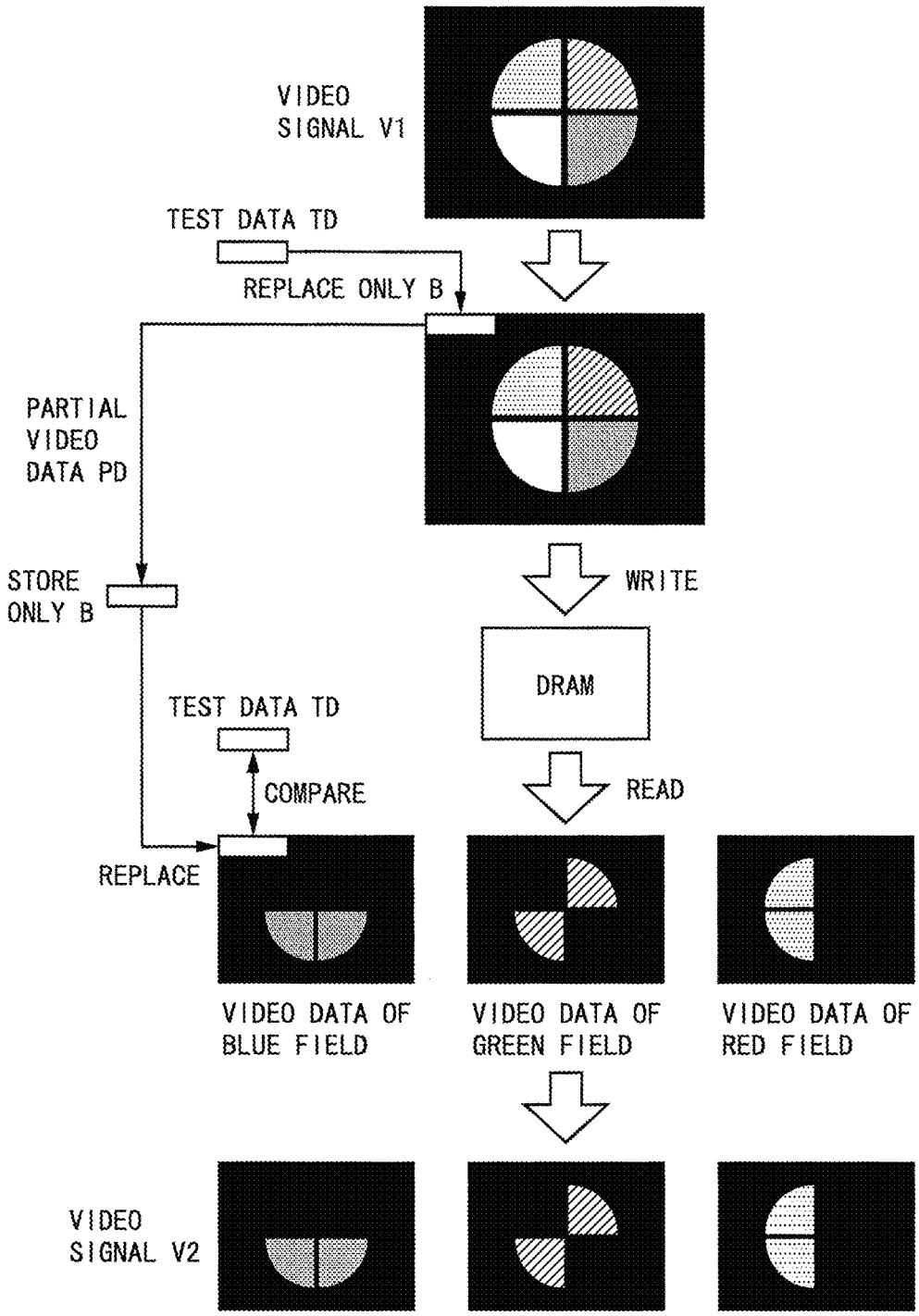
FIG. 9 is a diagram for explaining a check process in the liquid crystal display device according to the second embodiment.

FIG. 9 is a diagram for explaining the check process in the liquid crystal display device 30. In the present embodiment, p pixels aligned in the horizontal direction from the upper left corner of the display screen are taken as specific pixels, and pixel data of the blue field of the specific pixels in the video data of one frame is referred to as partial video data PD. The partial video data PD includes p pieces of q-bit pixel data. The partial video data PD is included in the head portion of the video signal V1 of one frame.

The check circuit 40 stores the partial video data PD (pixel data of the blue field of the p specific pixels aligned in the horizontal direction from the upper left corner of the display screen), and writes to the DRAM 13, video data obtained by replacing the partial video data PD with the test data TD. The check circuit 40 compares the test data TD' included in the video data read from the DRAM 13 with the original test data TD. When both match, the check circuit 40 obtains the video data VD by adding the stored partial video data PD to the remaining data RD' read from the DRAM 13. When both do not match, the check circuit 40 resets the DRAM 13.

In this manner, the display control circuit 32 checks whether the DRAM 13 is normal or abnormal, by storing the partial video data PD included in the video signal V1, writing to the DRAM 13, the video data obtained by replacing the partial video data PD with the test data TD, and comparing with the test data TD, the test data TD' included in the video data read from the DRAM 13. The display control circuit 32 replaces the test data TD' with the partial video data PD when the DRAM 13 is normal, and resets the DRAM 13 when the DRAM 13 is abnormal.

As described above, the liquid crystal display device 30 according to the present embodiment is a field sequential system display device, and the partial video data PD is pixel data of a first field (blue field) of a plurality of pixels (p pixels) aligned in the horizontal direction from the upper left corner of the display screen. The partial video data is included in the head portion of the first video signal (video signal V1) of one frame.

According to such a liquid crystal display device 30, as with the display device 10 according to the first embodiment, it is possible to check whether the frame memory is normal or abnormal. Furthermore, by resetting the frame memory when the frame memory is abnormal, the abnormal display due to the malfunction of the frame memory can be suppressed. Furthermore, by replacing the pixel data of the first field of the specific pixels with the test data TD, a circuit size can be reduced compared to a case in which the pixel data of all fields of the specific pixels are replaced with the test data TD.

Third Embodiment

A liquid crystal display device according to a third embodiment has a same configuration as the liquid crystal display device 30 according to the second embodiment (see FIG. 8). The liquid crystal display device according to the present embodiment is a field sequential system display device, and is also a see-through type display device. A display control circuit according to the present embodiment performs a check process, as with the display control circuits 12, 32 according to the first and second embodiments.

Figure 10:
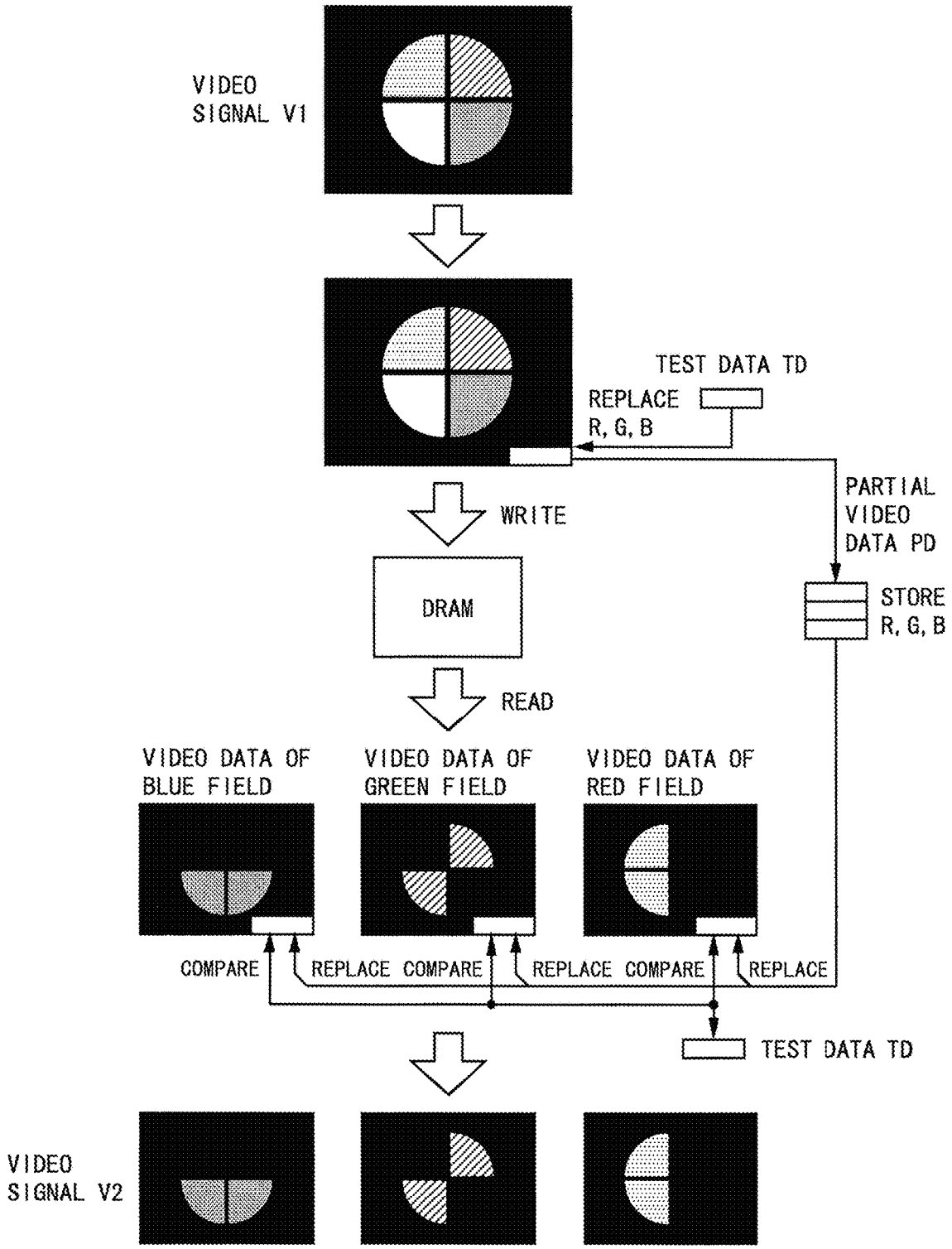
FIG. 10 is a diagram for explaining a check process in a liquid crystal display device according to a third embodiment.

FIG. 10 is a diagram for explaining the check process in the liquid crystal display device according to the present embodiment. In the present embodiment, p pixels aligned in the horizontal direction from a lower right corner of the display screen (p pixels aligned in a bottom line of the display screen in a right-justified manner) are taken as specific pixels, and out of the video data of one frame, pixel data of a blue field of the specific pixels is referred to as partial video data PDb, pixel data of a green field of the specific pixels is referred to as partial video data PDg, and pixel data of a red field of the specific pixels is referred to as partial video data PDr. The partial video data PDr, PDg, PDr respectively include p pieces of q-bit pixel data. The partial video data PDr, PDg, PDr are included in a tail portion of the video signal V1 of one frame.

A check circuit according to the present embodiment stores the partial video data PDr, PDg, PDr (pixel data of the red, green, and blue fields of the p specific pixels aligned in the horizontal direction from the lower right corner of the display screen), and writes to the DRAM 13, video data obtained by replacing all of the partial video data PDr, PDg, PDb with the test data TD. The check circuit compares the test data TD' included in video data of the blue field read from the DRAM 13 with the original test data TD. When both match, the check circuit obtains the video data VD of the blue field by adding the stored partial video data PDb to the remaining data RD' read from the DRAM 13. When both do not match, the check circuit resets the DRAM 13. The check circuit performs similar process with respect to video data of the green field and video data of the red field, both read from the DRAM 13.

Figure 11:
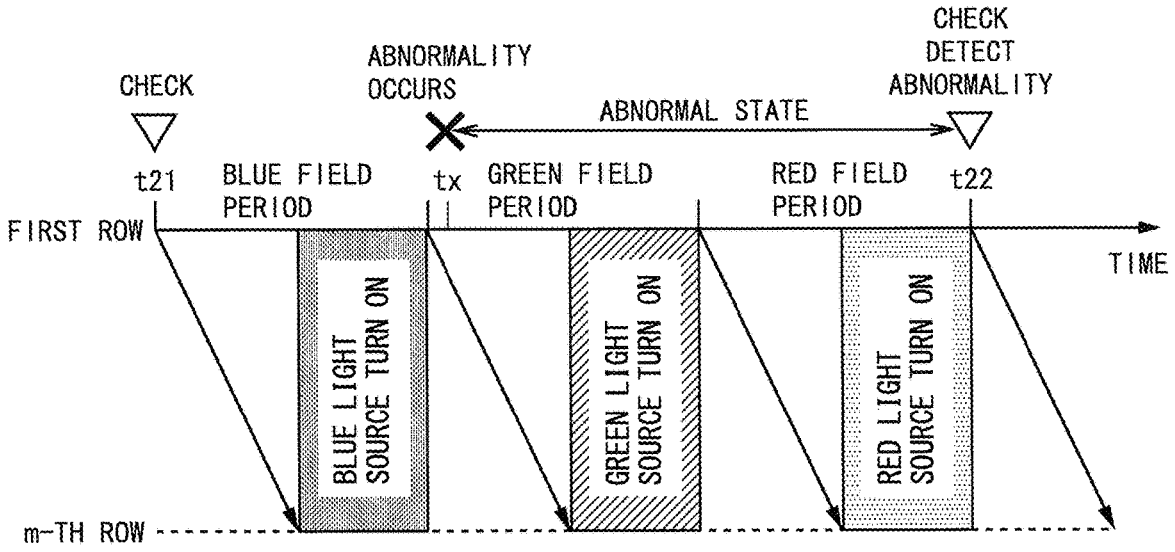
FIG. 11 is a diagram showing check timings and an abnormality detection timing in the liquid crystal display device according to the second embodiment.
Figure 12:
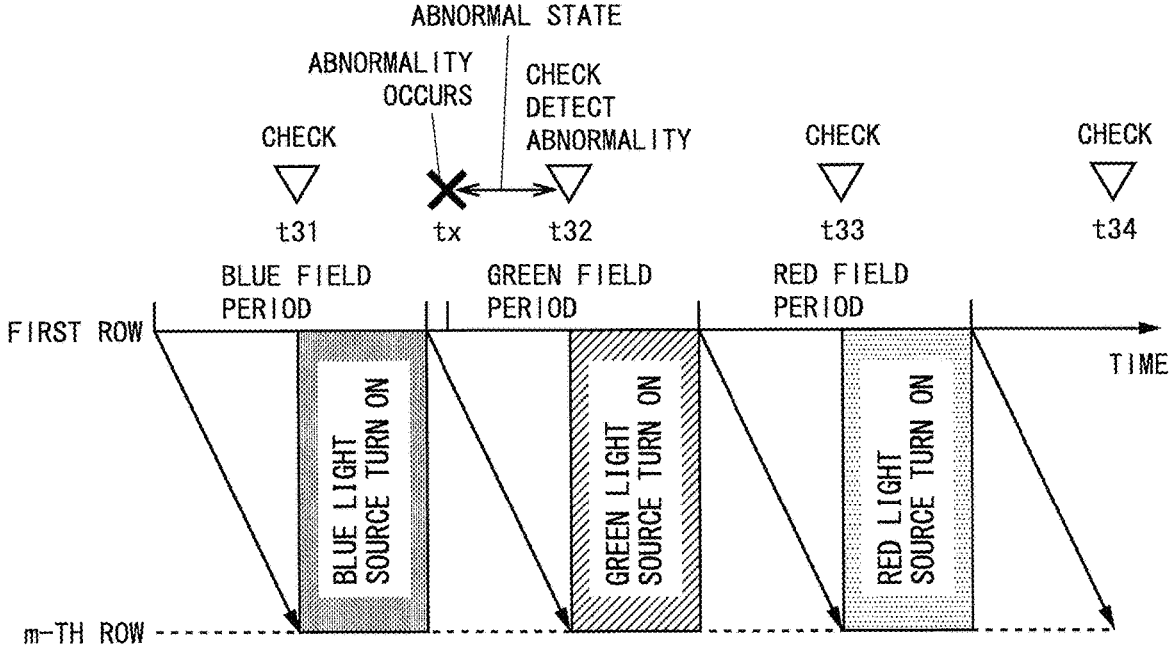
FIG. 12 is a diagram showing check timings and an abnormality detection timing in the liquid crystal display device according to the third embodiment.

FIG. 11 is a diagram showing check timings and an abnormality detection timing in the liquid crystal display device 30 according to the second embodiment. FIG. 12 is a diagram showing check timings and an abnormality detection timing in the liquid crystal display device according to the present embodiment. In FIGS. 11 and 12, a triangle indicates the check timing, a cross mark indicates the abnormality detection timing, a slanting arrow indicates rows of pixels to which pixel data is written, and rectangles indicate lighting periods of three kinds of light sources included in the backlight.

In the liquid crystal display device 30 according to the second embodiment (FIG. 11), pixel data of p pixels in the head portion of the first field is replaced with the test data TD, and the check process is performed once in one frame period. In FIG. 11, after the check process is performed at time t21, the check process is performed at time t22. Thus, when the DRAM 13 falls in an abnormal state at time tx, the DRAM 13 continues to malfunction in the abnormal state in the green field period and the red field period. As a result, an abnormal display occurs in the green field period and the red field period.

In the liquid crystal display device according to the present embodiment (FIG. 12), pixel data of p pixels in the tail portion of each field are replaced with the test data TD, and the check process is performed three times in one frame period. In FIG. 12, after the check process is performed at time t31, the check process is performed at times t32, t33, t34. Thus, when the DRAM 13 falls in an abnormal state at time tx, the abnormality of the DRAM 13 is detected by the check process at the time t32, and the DRAM 13 is reset at the time t32. Therefore, the DRAM 13 is already in a normal state in the green field period. Furthermore, if the reset of the DRAM 13 is completed before turning on of the backlight, an abnormal display does not occur in the green field. According to the liquid crystal display device according to the present embodiment, the abnormality of the DRAM 13 can be detected before turning on of the backlight, and the abnormal display due to the malfunction of the DRAM 13 can be suppressed at an early time.

As described above, the liquid crystal display device according to the present embodiment is a field sequential system display device, and the partial video data PD is pixel data of each field (blue, green, and red fields) of a plurality of pixels (p pixels) aligned in the horizontal direction from the lower right corner of the display screen. The partial video data PDr, PDg, PDr are included in the tail portion of the first video signal of one frame.

According to such a liquid crystal display device, as with the display devices 10, 30 according to the first and second embodiments, it is possible to check whether the frame memory is normal or abnormal. Furthermore, by resetting the frame memory when the frame memory is abnormal, the abnormal display due to the malfunction of the frame memory can be suppressed. Furthermore, by replacing the pixel data of all fields of the specific pixels with the test data TD, the abnormality of the frame memory can be detected at an earlier time and the abnormal display due to the malfunction of the frame memory can be suppressed at an earlier time, compared to a case in which the pixel data of a field of the specific pixels is replaced with the test data TD.

Although the present invention is described in detail in the above, the above description is exemplary in all of the aspects and is not restrictive. It is understood that various other changes and modification can be derived without going out of the present invention.

What is claimed is:

1. A display device comprising:

a display panel;

a frame memory;

a display control circuit configured to perform a predetermined process on a first video signal using the frame memory and output an obtained second video signal; and a panel drive circuit configured to drive the display panel based on the second video signal, wherein the display control circuit is configured to check whether the frame memory is normal or abnormal, by:

storing partial video data which is pixel data of specific pixels and is included in the first video signal of one frame, writing, to the frame memory, video data obtained by replacing the partial video data with test data as first test data, reading, from the frame memory, the video data obtained by replacing the partial video data with the test data as second test data, comparing the first test data with the second test data to check whether the frame memory is normal or abnormal;

replacing the second test data with the partial video data when the frame memory is normal, and resetting the frame memory when the frame memory is abnormal.

2. The display device according to claim 1, wherein the frame memory is a dynamic random access memory having a reset function.

3. The display device according to claim 2, wherein the partial video data is pixel data of a plurality of pixels aligned along an edge of a display screen.

4. The display device according to claim 3, wherein the partial video data is the pixel data of the plurality of pixels aligned in a horizontal direction from an upper left corner of the display screen.

5. The display device according to claim 4, wherein the partial video data is included in a head portion of the first video signal of one frame.

6. The display device according to claim 3, wherein the display device is a field sequential system display device, and the partial video data is the pixel data of a first field of the plurality of pixels aligned in a horizontal direction from an upper left corner of the display screen.

7. The display device according to claim 6, wherein the partial video data is included in a head portion of the first video signal of one frame.

8. The display device according to claim 3, wherein the display device is a field sequential system display device, and the partial video data is the pixel data of each field of the plurality of pixels aligned in a horizontal direction from a lower right corner of the display screen.

9. The display device according to claim 8, wherein the partial video data is included in a tail portion of the first video signal of one frame.

10. The display device according to claim 2, wherein the first test data includes a plurality of pieces of data that are different from each other, and with respect to any bit of the data, the first test data includes data having zero as a value of the bit and data having one as the value of the bit.

11. A method for controlling a display device including a display panel and a frame memory, the method comprising:

performing a predetermined process on a first video signal using the frame memory and outputting an obtained second video signal;

driving the display panel based on the second video signal; and checking whether the frame memory is normal or abnormal, wherein the checking includes:

storing partial video data which is pixel data of specific pixels and is included in the first video signal of one frame;

writing, to the frame memory, video data obtained by replacing the partial video data with test data as first test data;

reading, from the frame memory, the video data obtained by replacing the partial video data with the test data as second test data;

comparing the first test data with the second test data to check whether the frame memory is normal or abnormal;

replacing the second test data with the partial video data when the frame memory is normal; and resetting the frame memory when the frame memory is abnormal.

12. The method for controlling the display device according to claim 11, wherein the frame memory is a dynamic random access memory having a reset function.

* * * * *